US008007303B2

(12) United States Patent
Yao et al.

(10) Patent No.: US 8,007,303 B2
(45) Date of Patent: Aug. 30, 2011

(54) CARD EDGE CONNECTOR WITH AN IMPROVED RETAINER

(75) Inventors: Ze-Lin Yao, Kunshan (CN); Zhuang-Xing Li, Kunshan (CN); Ting-Shun Liu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/890,717

(22) Filed: Sep. 27, 2010

(65) Prior Publication Data

US 2011/0076868 A1 Mar. 31, 2011

(30) Foreign Application Priority Data

Sep. 29, 2009 (CN) ..... 2009 2 0311849

(51) Int. Cl.
*H01R 13/62* (2006.01)

(52) U.S. Cl. ..... 439/327; 439/153

(58) Field of Classification Search ..... 439/325–329, 439/153, 260, 377

See application file for complete search history.

(56) References Cited

U.S. PATENT DOCUMENTS

| | | | | | |
|---|---|---|---|---|---|
| 4,823,951 | A * | 4/1989 | Colomina | ..... | 439/327 |
| 5,145,396 | A * | 9/1992 | Yeung | ..... | 439/326 |
| 5,417,580 | A * | 5/1995 | Tsai | ..... | 439/328 |
| 5,842,880 | A * | 12/1998 | Pei | ..... | 439/327 |
| 5,902,143 | A * | 5/1999 | Pan et al. | ..... | 439/327 |
| 5,980,299 | A * | 11/1999 | Davis | ..... | 439/377 |
| 6,045,385 | A * | 4/2000 | Kane | ..... | 439/327 |
| 6,126,471 | A * | 10/2000 | Yu et al. | ..... | 439/327 |
| 6,168,450 | B1 * | 1/2001 | Davis et al. | ..... | 439/325 |
| 7,244,134 | B2 * | 7/2007 | Ju | ..... | 439/327 |
| 7,517,239 | B1 | 4/2009 | Ju | | |

* cited by examiner

*Primary Examiner* — Briggitte R Hammond

(74) *Attorney, Agent, or Firm* — Wei Te Chung; Andrew C. Cheng; Ming Chieh Chang

(57) ABSTRACT

A card edge connector for mating with an electronic card includes an elongated housing, a number of contacts and a retainer retained to the housing. The housing has a pair of side walls, a central slot between the side walls and a first tower upwardly extending at one end thereof. The first tower defines a first U-shaped cavity downwardly extending from a top end thereof and a mounting slot upwardly extending from a lower end thereof and located at outside of the first cavity. The first cavity communicates with the central slot along a length direction of the housing to receive the electronic card. The retainer has a non-flexible fastening portion retained in the mounting slot and a flexible locking barb obliquely protruding into the first cavity from a top end of the fastening portion to lock with the electronic card.

20 Claims, 8 Drawing Sheets

CARD EDGE CONNECTOR WITH AN IMPROVED RETAINER

BACKGROUND OF THE INVENTION

1. Field of the Invention

The present invention relates to card edge connectors, more particularly to card edge connectors with an improved retainer.

2. Description of Related Art

Card edge connectors are employed widely in computers to receive a memory card, graphic card, network interface et al. The card edge connector usually have an elongated housing, a plurality of contacts retained in the housing for electrically connecting a corresponding mating card, and at least a retainer at one end thereof for locking the mating card. The housing has a pair of side walls, a central slot between the side walls for receiving the mating card, and a first tower at one end thereof. The first tower defines a mounting slot extending therethrough along an up to down direction and a pair of limiting walls at two sides of the mounting slot. The retainer is upwardly assembled to the mounting slot and upwardly extends beyond the first tower. The retainer has a retaining portion at a lower side thereof and a flexible arm portion upwardly extending from the retaining portion. The retaining portion is wider than the arm portion, and the mounting slot is formed with a step portion at inner side thereof to limit the retaining portion from moving upwardly. The arm portion has a guiding portion upwardly and sidewardly extending beyond the first tower at an upper side thereof for guiding the electronic card being inserted into the central slot and a locking projection inwardly extending to lock with the electronic card.

In an insertion process of the electronic card, a side edge of the electronic card downwardly moves between the limiting walls along the guiding portion, at this time, the electronic card sidewardly resists the arm portion; when the electronic card is fully inserted into the central slot, the arm portion rebounds to make the locking projection lock with the electronic card for preventing the electronic card from moving upwardly.

However, because the arm portion is flexible, the electronic card can be pushed to move along a length direction when an electrical device which is mounted with the card edge connector and the electronic card is vibrated, an electrical connection between the card edge connector and the electronic card would be affected to be unstable; besides, the first tower is only formed with the step portion to prevent the mounting portion of the retainer from moving upwardly, while there is not any other structure to prevent the retainer from moving downwardly, therefore, the retainer can be pushed downwardly out of the housing when the electronic card downwardly presses the guiding portion in the insertion process of the electronic card.

Hence, an improved card edge connector is desired to overcome the above problems.

BRIEF SUMMARY OF THE INVENTION

According to one aspect of the present invention, a card edge connector for mating with an electronic card, comprises: an elongated housing having a pair of opposed side walls, a central slot between the side walls for receiving a lower edge of the electronic card and a first tower upwardly extending at one end thereof, the first tower defining a first U-shaped cavity downwardly extending along an insertion direction of the electronic card from a top end thereof and a mounting slot upwardly extending from a lower end thereof and located at outside of the first cavity along a length direction of the housing, the first cavity communicating with the central slot along a length direction of the housing to receive a side edge of the electronic card, and the mounting slot communicating with the first cavity along the length direction; a plurality of contacts retained to the housing; and a retainer having a non-flexible fastening portion retained in the mounting slot and a flexible locking barb obliquely protruding into the first cavity from a top end of the fastening portion to lock with the electronic card.

According to another aspect of the present invention, a card edge connector for mating with an electronic card, comprises: an elongated housing having a pair of opposed side walls, a central slot extending along a length direction between the side walls, a first tower and a second tower upwardly extending from opposite two ends thereof, each first tower and second tower defining a U-shaped cavity downwardly recessed from a top end thereof to receive two side edges of the electronic card and preventing the electronic card from moving along a length direction of the housing; a plurality of contacts retained to the housing; a retainer hid in the first tower and not upwardly exposing to exterior, the retainer a non-flexible fastening portion retained in the housing and a flexible locking barb obliquely extending into the first cavity from a top end of the fastening portion to lock with the electronic card; and an ejector retained to the second tower and having a locking projection inwardly extending and located at an upper outer side of the cavity to lock with another side of the electronic card.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
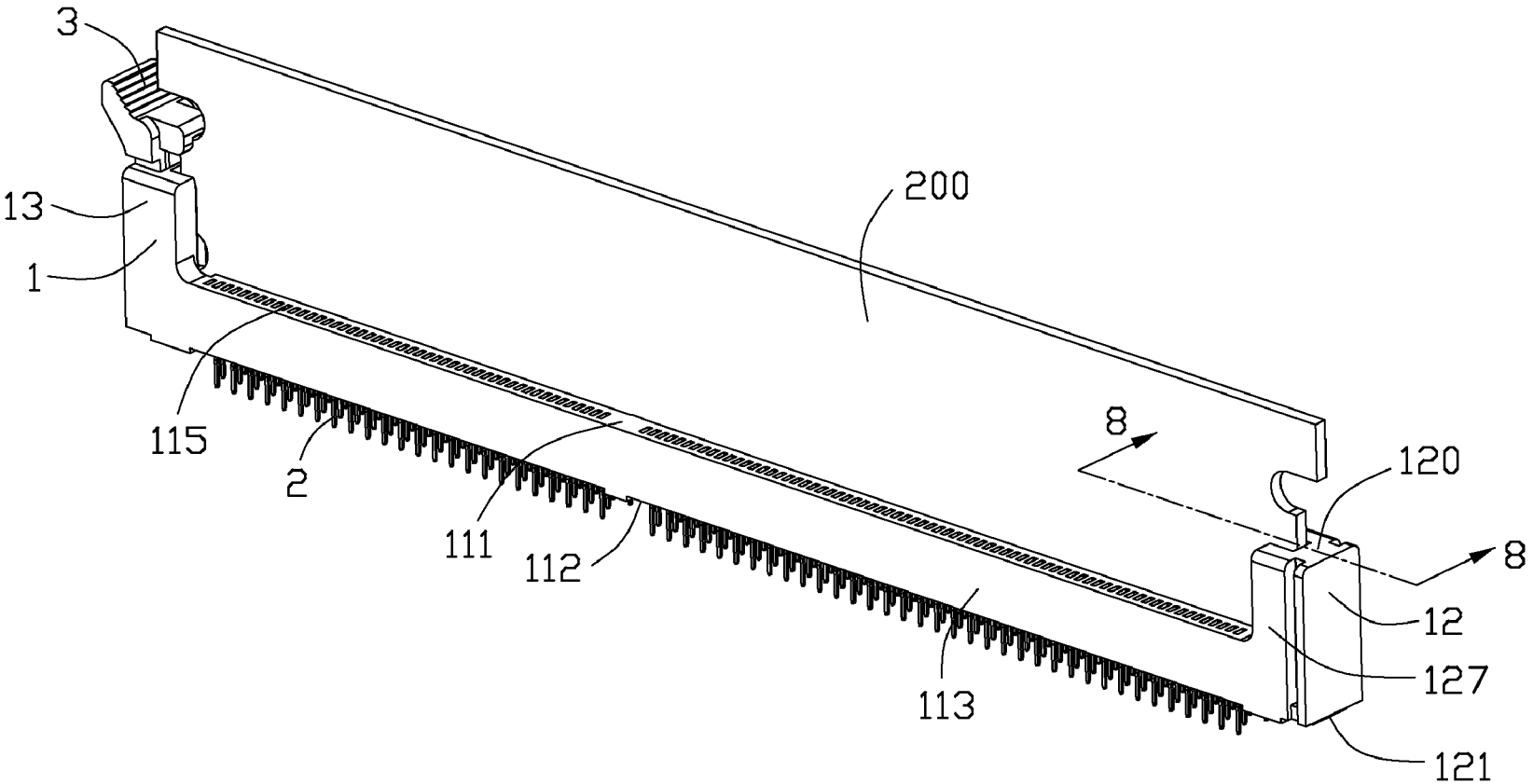
FIG. 1 is a perspective view of a card edge connector according to the present invention with an electronic card being inserted therein.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-8, a card edge connector 100 for mating with an electronic card 200 according to the present invention is disclosed. The card edge connector 100 comprises an elongated housing 1, a plurality of contacts 2 retained in the housing 1, and a retainer 4 and an ejector 3 attached to opposite two ends of the housing 1 to lock with the electronic card 200. The electronic card 200 has a lower edge 201 with a plurality of metal fingers (not shown) to electrically connect with the contacts 2, and a left side edge 202 and a right side edge 203 at two side thereof. Each side edge 202, 203 defines an upper notch 204 and a lower notch 205 to lock with the card edge connector 100.

Referring to FIGS. 1-8, the housing 1 has an elongated body portion 10 extending along a length direction thereof, a first tower 12 and a second tower 13 respectively extending upwardly from opposite two ends of the body portion 10. The body portion 10 has a bottom wall 112, a top wall 111, a pair of side walls 113 connecting the bottom wall 112 and the top wall 111 and extending along the length direction, and a central slot 114 between the side walls 113 to receive the lower edge 201 of the electronic card 200. Each side wall 113 defines a plurality of passageways 115 extending through the bottom wall 112 and the top wall 111. The passageways 115 communicate with the central slot 114. The housing 1 is formed with a partition board 1141 in the central slot 114 to divide the central slot 114 to two parts with different length for preventing the electronic card 200 from mis-mating.

Referring to FIGS. 2-5, the first tower 12 has a top surface 120 and a bottom surface 121 respectively located at top and bottom side thereof and two first side surfaces 127 between the top surface 120 and the bottom surface 121. The top surface 120 is higher than the top wall 111 of the body portion 10. The bottom surface 121 and the bottom wall 112 are located at a common plane. The first tower 12 defines a first U-shaped cavity 128 extending along an insertion direction of the electronic card 200, and communicating with the central slot 114 along the length direction of the housing 1 to receive the right side edge 203 of the electronic card 200. The first cavity 128 is formed between the first side surfaces 127. Three inner walls of the first cavity 128 can prevent the electronic card 200 from moving along the length direction and a front to back direction perpendicular to the length direction and the insertion direction. The inner walls of the first cavity 128 each is formed with an inclined surface at a top end thereof for guiding the right side edge 203 of the electronic card 200 to be inserted into the first cavity 128.

The first tower 12 defines a mounting slot 122 and a receiving slot 123 recessed upwardly from the bottom surface 121 to receive the retainer 4, and a pair of openings 129 respectively recessed from the side surfaces 127. The mounting slot 122 and the receiving slot 123 do not upwardly extend through the first tower 12, and the mounting slot 122 is formed with a resisting wall 1221 at an inner top wall thereof. The openings 129 communicate with the mounting slot 122 along the front to back direction to lock with the retainer 4. The receiving slot 123 is located between the fist cavity 128 and the mounting slot 122, and sidewardly communicates with the first cavity 128 along the length direction. The first tower 12 is formed with a limiting wall 124 between the receiving slot 123 and the mounting slot 122. The limiting wall 124 defines a rectangular limiting slot 126 recessed from a bottom end thereof to communicate the receiving slot 123 and the mounting slot 122 along the length direction. The limiting slot 126 is narrower than the mounting slot 122 along the front to back direction to prevent the retainer 4 from moving along the front to back direction.

The second tower 13 defines a second U-shaped cavity 134 extending along the insertion direction of the electronic card 200, and communicating with the central slot 114 along the length direction to receive the left side edge 202 of the electronic card 200. Three inner walls of the second cavity 134 can prevent the electronic card 200 from moving along the length direction and the front to back direction. The second tower 13 further has a receiving space 132 at an outer side of the second cavity 134 to retain the ejector 3, and a partition plate 1321 between the second cavity 134 and the receiving space 132. Each inner side wall of the receiving space 132 defines an axle hole 136 and a cutout 137 communicating with the receiving space 132 along the front to back direction. The axle hole 136 is located below the cutout 137. The second cavity 134 communicates with the receiving space 132 at a lower side thereof.

Figure 2:
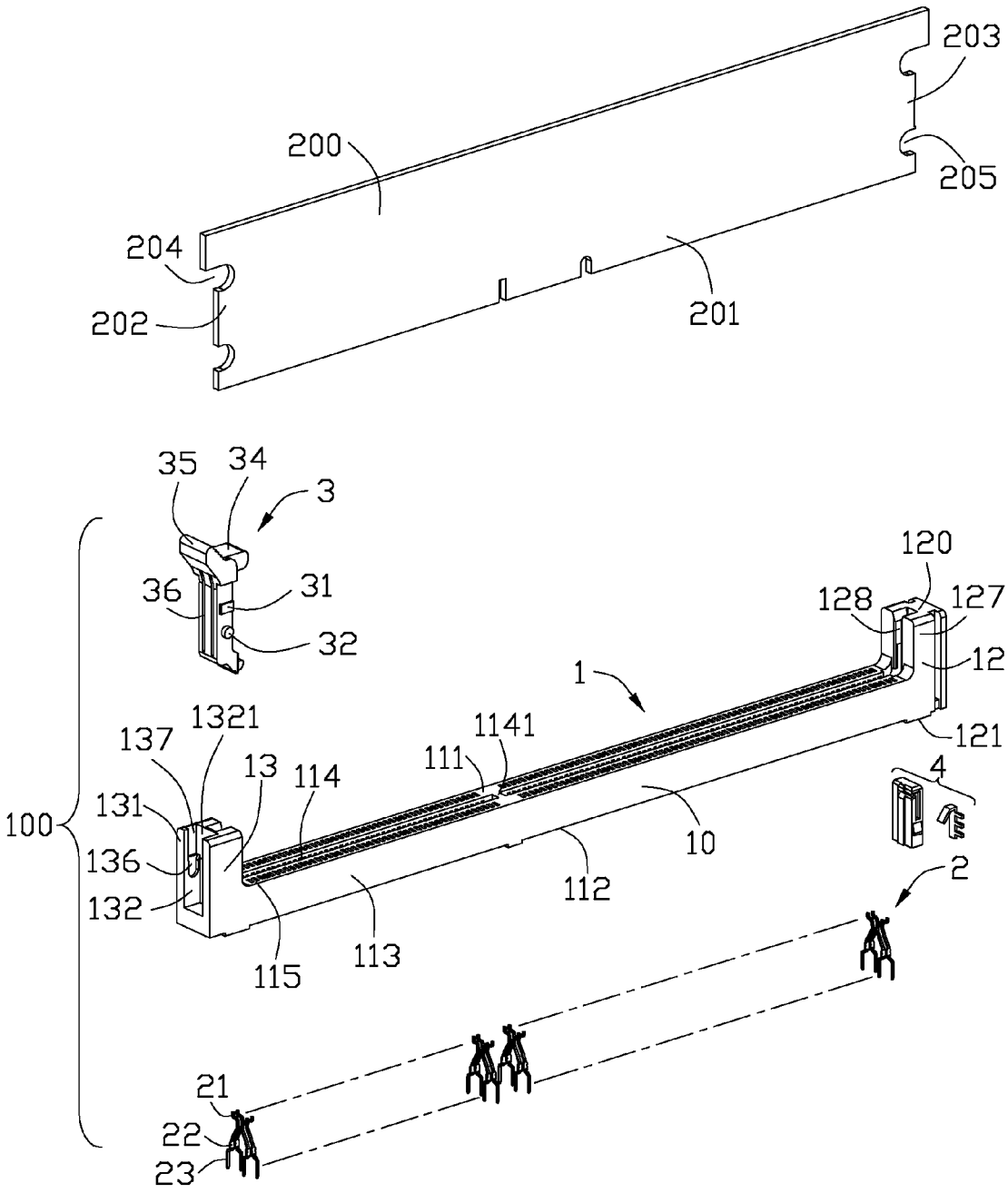
FIG. 2 is an exploded view of the card edge connector and the electronic card shown in FIG. 1.
Figure 3:
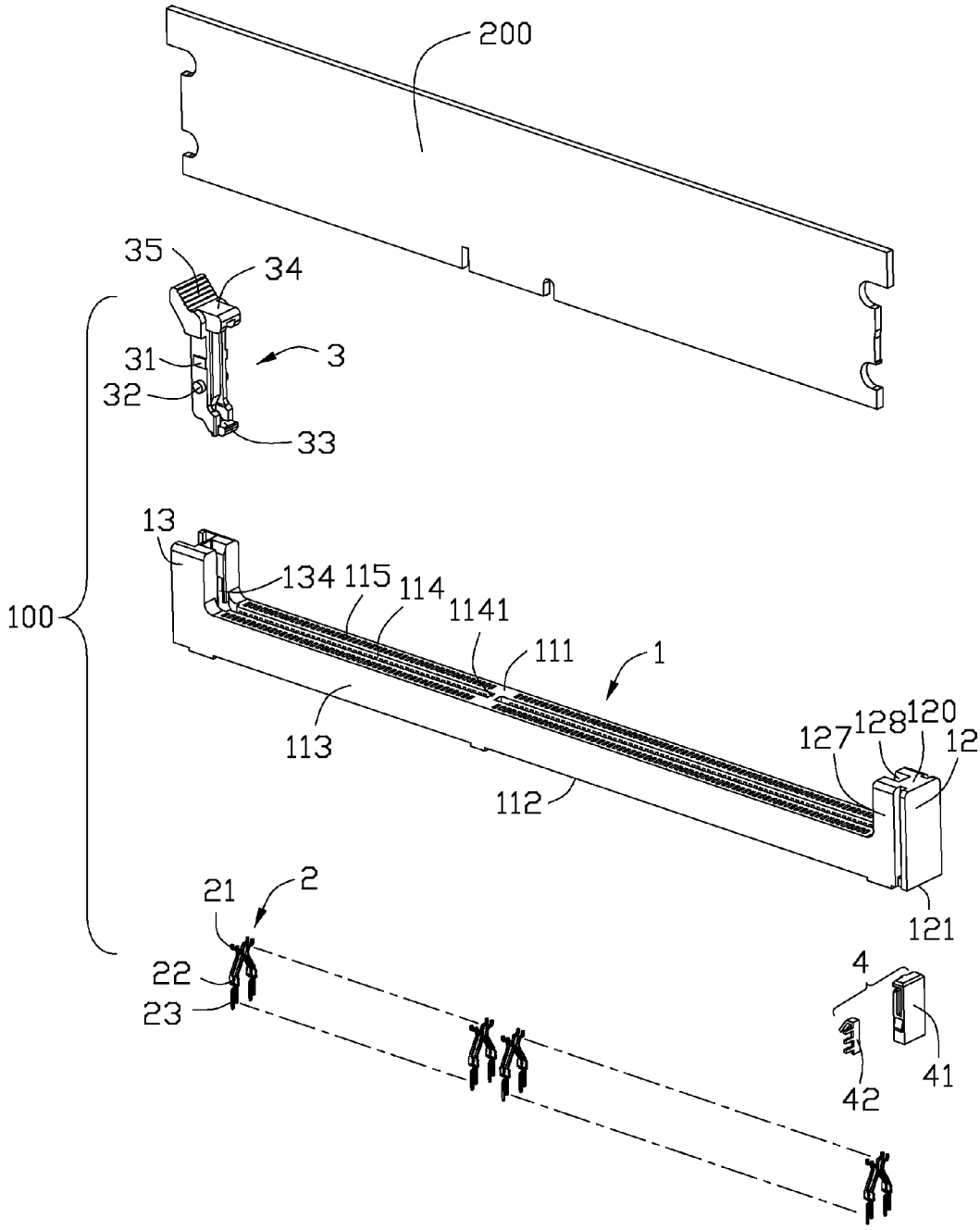
FIG. 3 is a view similar to FIG. 2, while taken from a different aspect.
Figure 4:
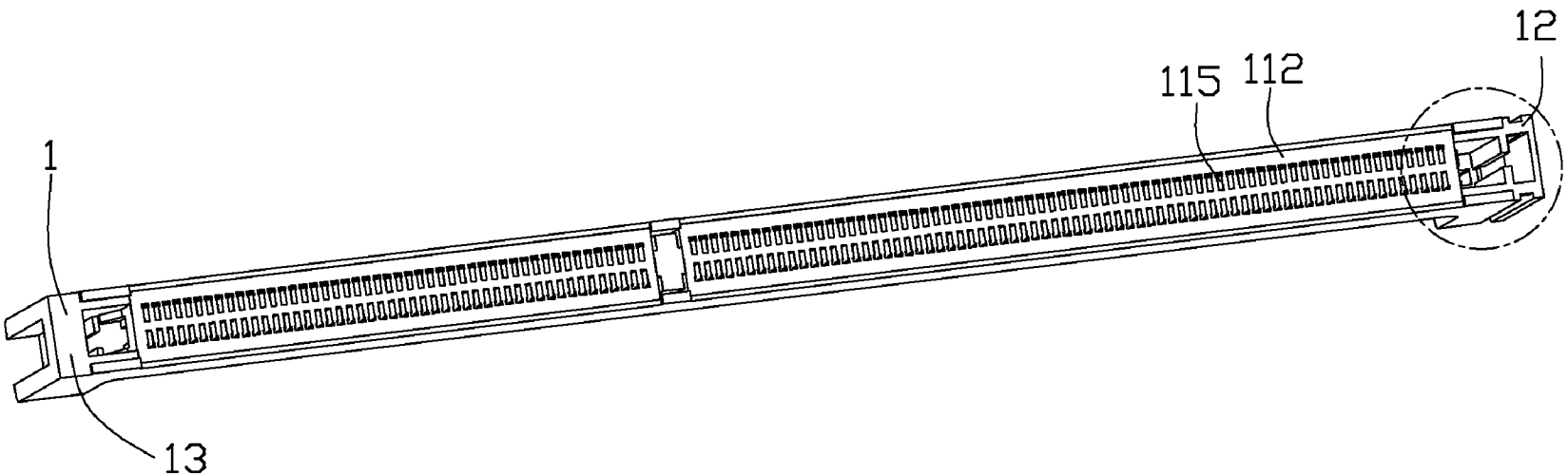
FIG. 4 is a perspective view of a housing of the card edge connector shown in FIG. 2.
Figure 5:
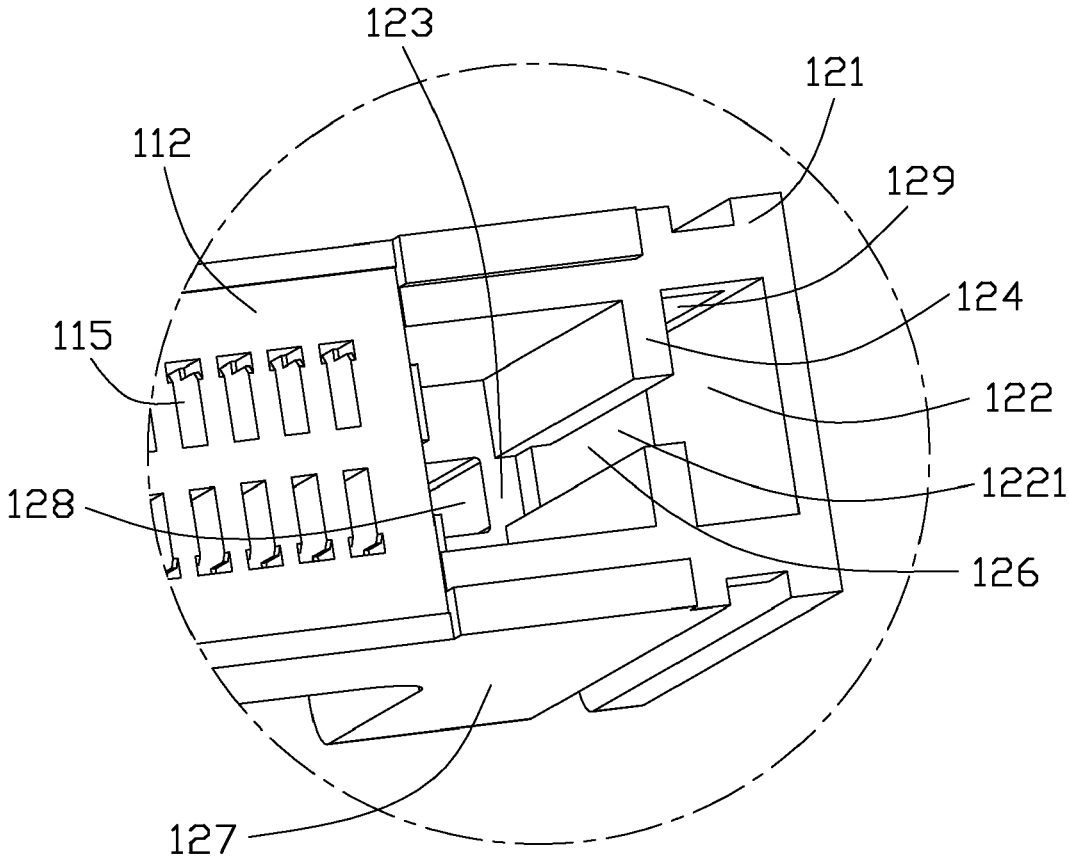
FIG. 5 is a partly exploded view of the housing shown in FIG. 4.

Referring to FIGS. 2-3, the contacts 2 are arranged in two rows respectively received in the passageways 115 of the two side walls 113. Each contact 2 has a securing portion 22 retained in the passageways 115, a contact portion 21 upwardly extending from a top end of the securing portion 22, and a tail portion 23 downwardly extending out of bottom wall 112 from a lower end of the securing portion 22. The contact portions 21 protrude into the central slot 114 to electrically connect with the metal fingers of the electronic card 200. The tail portions 23 are arranged in four rows to connect with a mother board (not shown).

Referring to FIGS. 2 and 3, the ejector 3 has a base portion 36 retained in the receiving space 132, an upper inner locking projection 34 inwardly extending from a top end of the base portion 36, an upper outer operator 35 outwardly extending from the top end of the base portion 36, and a lower kicker 33 inwardly extending from a lower end of the base portion 36 to eject the electronic card 200 out of the central slot 114. The base portion 36 is formed with a pair of pivots 32 outwardly extending from two sides thereof to engage with the axle holes 136 and a pair of protrusions 31 protruding outwardly to lock with the cutouts 137. The upper inner locking projector 34 is located at an upper outer side of the second tower 13 and inwardly extending to an upper outer side of the second cavity 134 to lock with the upper notch 204 of the right side edge 203 of the electronic card 200. The upper outer operator 35 extends beyond the second tower 13 for being conveniently operated. The lower kicker 33 extends to a lower side of the first cavity 128 to resist the lower edge 201 of the electronic card 200.

Figure 6:
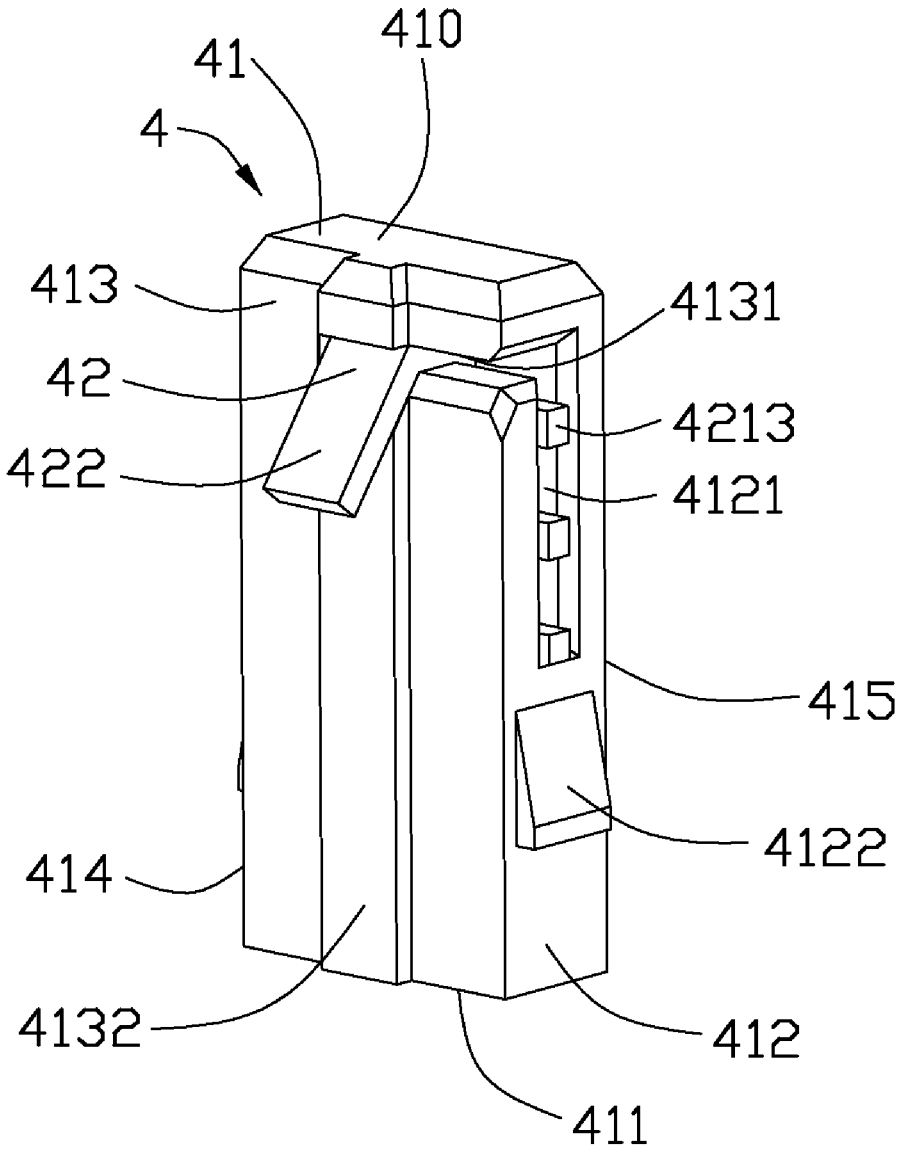
FIG. 6 is a perspective view of a retainer of the card edge connector.
Figure 7:
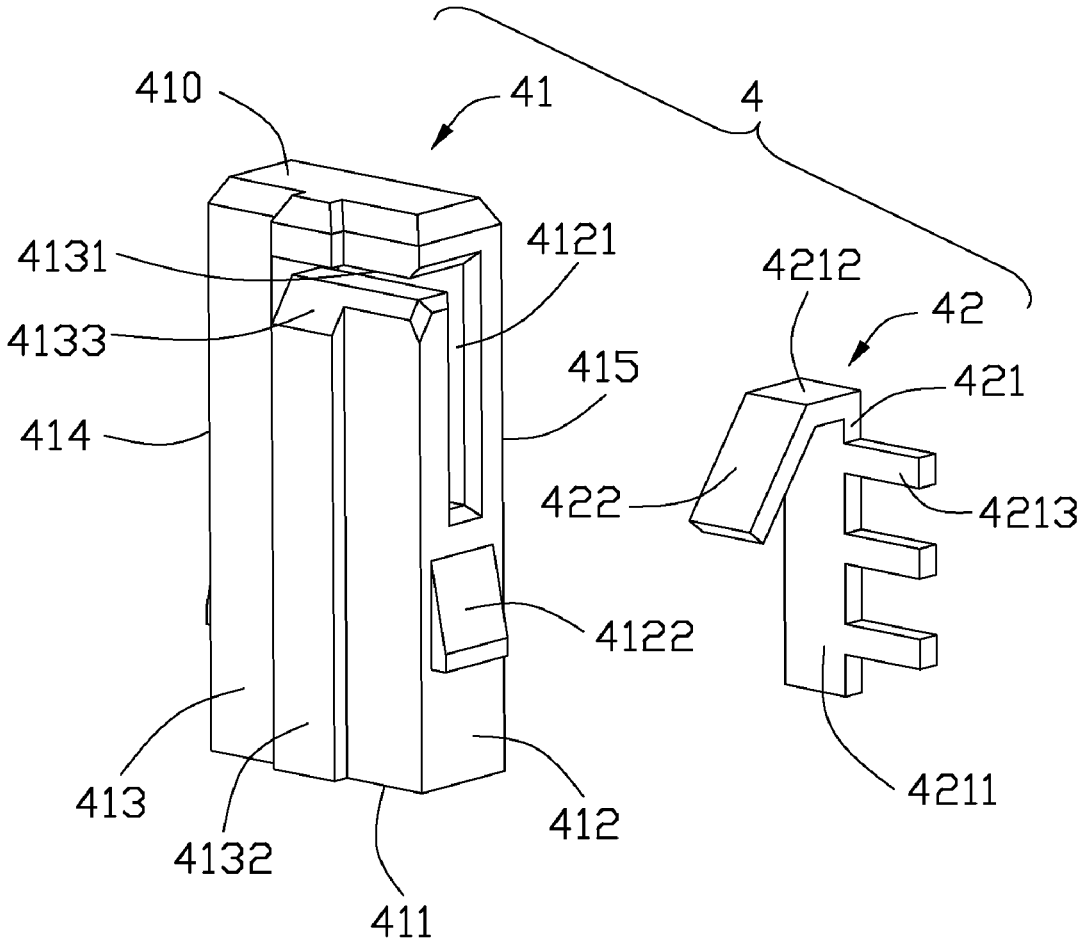
FIG. 7 is an exploded view of the retainer shown in FIG. 6.
Figure 8:
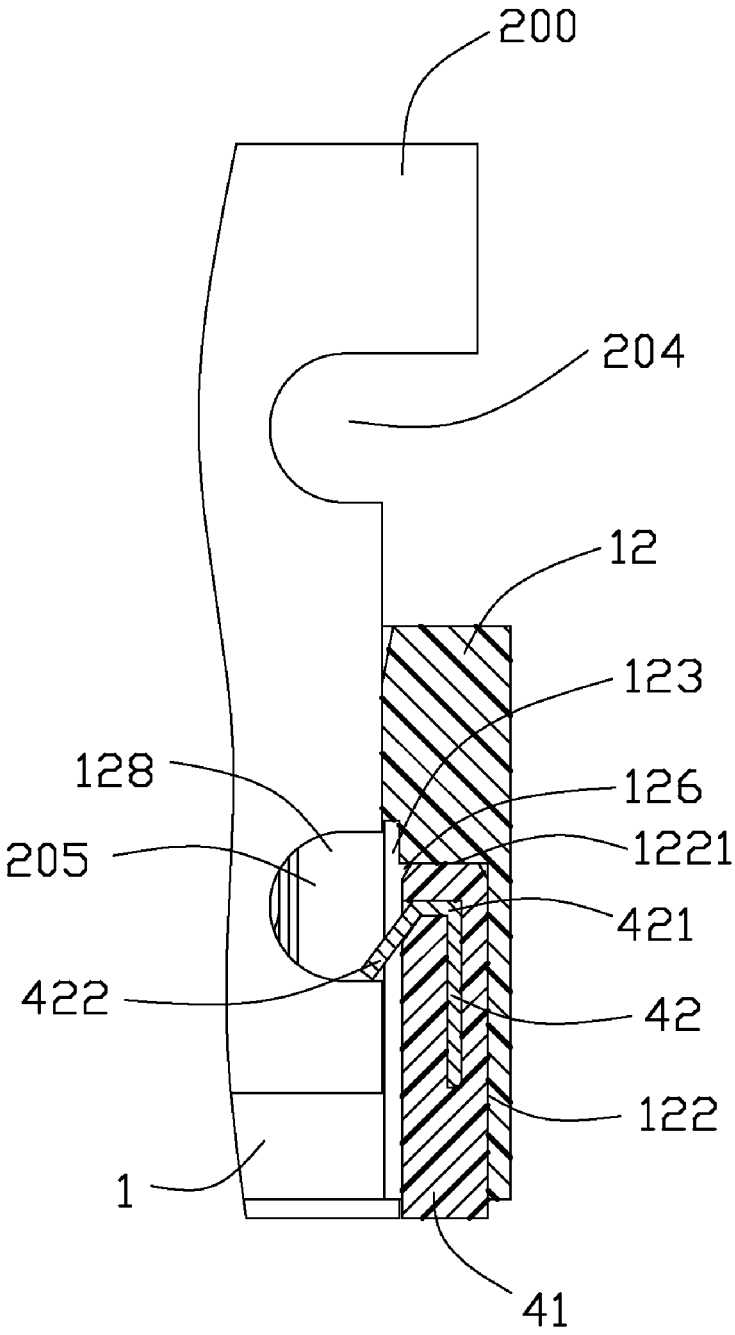
FIG. 8 is a partly cross-section view taken along line 8-8 of FIG. 1.

Referring to FIGS. 6-8, the retainer 4 comprises an insulator 41 and a metal locker 42 retained in the insulator 41 and protruding into the first cavity 128 to lock the electronic card 200. The insulator 41 presents as a rectangular block. The insulator 41 has an upper surface 410 and a lower surface 411 respectively located at upper and lower sides thereof, a front surface 412 and a rear surface 414 respectively located at front and rear sides thereof, and an inner surface 413 and an outer surface 415 respectively located at inner and outer sides thereof along the length direction. The insulator 41 defines a vertical groove 4121 recessed from the front surface 412 and a lateral groove 4131 recessed from the inner surface 413. The vertical groove 4121 extends along an up to down direction of the housing 1, and does not upwardly and downwardly extend through the insulator 41. The lateral groove 4131 communicates with a top end of the vertical groove 4121 along the length direction, and extends through the front surface 412 to make the grooves 4121, 4131 prevent as L-shaped groove. Inner walls of the vertical groove 4121 and the lateral groove 4131 are formed with inclined guiding faces to guide an insertion of the locker 42.

The insulator 41 has a pair of blocks 4122 protruding outwardly from the front and rear surfaces 412, 414 respectively. The blocks 4122 lock with the openings 129 of the first tower 12 to prevent the insulator 41 from moving downwardly in the mounting slot 122. The blocks 4122 are located at a lower side of the vertical groove 4121 along the up to down direction. The insulator 41 is formed with a raised portion 4132 extending outwardly from a middle position of the inner surface 413 to engage with the limiting slot 126 for preventing the insulator 41 from moving along the front to back direction. The raised portion 4132 extends along the insertion direction, and upwardly extends to the upper surface 410 and downwardly extends to the lower surface 411. The lateral groove 4131 extends through the raised portion 4132 along the front to back direction and the length direction. The raised portion 4132 is formed with an inclined surface 4133 between an intersection position of the raised portion 4132 and a lower inner wall of the lateral groove 4131.

The locker 42 has a non-flexible retaining portion 421 assembled to the vertical groove 4121 along the front to back direction and a flexible locking barb 422 sidewardly and downwardly bending from a top end of the retaining portion 421. The retaining portion 421 has a vertical portion 4211 retained in the vertical groove 4121 and a level portion 4212 extending inwardly from a top end of the vertical portion 4211 along the length direction to engage with the lateral groove 4131, thereby the retaining portion 421 presents as L-shaped. The locking barb 422 obliquely and downwardly extends from a free end of the level portion 4212. The locking barb 422 and the level portion 4212 define an obtuse angle therebetween to make the locking barb 422 sidewardly extending through the receiving slot 123 and protruding into the first cavity 128 along the length direction. Besides, the oblique locking barb 4212 can guide the electronic card 200 to be downwardly inserted into the first cavity 128. An upper portion of the locking barb 422 is located upon the inclined surface 4133, and a lower portion of the locking barb 422 obliquely extends out of the insulator 41 along the length direction. The lower portion of the locking barb 422 and the inner surface 413 define an acute angle therebetween to limit a deformation of the locking barb 422 in the insertion process of the electronic card 200. Besides, the receiving slot 123 is located between the inner surface 413 and the first cavity 128 for supplying a deformation space to the locking barb 411 and preventing the locking barb 422 from being deformed overly. Therefore, the lower portion of the locking barb 422 can be resisted outwardly into the receiving slot 123 and can not resist the inner surface 413 in the insertion direction of the electronic card 200, and rebounds to lock with the lower notch 205 of the right side edge 203 of the electronic card 200 when the electronic card 200 is completely inserted into the card edge connector 100.

The vertical portion 4211 has a base 4214 and three carriers 4213 forwardly extending from a front side of the base 4214 along the front to back direction. The locking barb 422 bends from a top end of the base 4214. The locking barb 422, the level portion 4212 and the base 4214 have a same width along the front to back direction. The carriers 4213 and the base 4214 are located at a common plane and perpendicular to each other. The lockers 42 can be connected with each other for being mass-produced. Of course, the quantity of carriers 4213 can be more than three or less than three.

The retainer 4 in the present invention is separated from the housing 1 and has the separated insulator 41 and locker 42, therefore, the locker 42 can be made of the metal material which has the desirable abrasion resistance, and the housing 1 and insulator 41 can be still made by an ordinary insulative material, which can increase the abrasion resistance of the locking barb 42 and prolong the life of the card edge connector 100. Besides, the housing 1 and insulator 41 do not need to be made of the insulative material with desirable abrasion resistance, which would decrease a manufacture cost of the card edge connector 100 with well abrasion resistance.

In an assembly process of the retainer 4: firstly, assembling the locker 42 to the insulator 41 along the front to back direction, then the vertical portion 4211 is retained in the vertical groove 4121 and upwardly resists a top inner wall of the vertical groove 4121, and downwardly resists a bottom inner wall of the vertical groove 4121 to prevent the locker 42 from moving along the up to down direction; the level portion 4212 is retained in the lateral groove 4131, and the locking barb 422 sidewardly extends out of the inner surface 413 along the length direction; secondly, assembling the retainer 4 to the mounting slot 122 of the housing 1 along a lower to upper direction, then the upper surface 410 upwardly resists the resisting wall 1221 of the mounting slot 122 to prevent the retainer 4 from moving upwardly, the blocks 4122 lock with the openings 129 to prevent the retainer 4 from moving downwardly, besides, the raised portion 4132 and the locking barb 422 of the locker 42 are retained in the limiting slot 126 to prevent the retainer 4 from moving along the front to back direction; the locking barb 422 sidewardly extends into the first cavity 128 along the length direction. Therefore, the retainer 4 is hid in the housing 1 and does not upwardly extend out of the housing 1, then the retainer 4 can be protected from being collided unexpectedly.

In the insertion process of the electronic card 200, firstly, rotating the ejector 3 outwardly to release the second cavity 134; then inserting the electronic card 200 downwardly, the electronic card 200 would outsidely resist the locking barb 422, then the locking barb 422 would be resisted into the receiving slot 123 and have a small deformation; secondly, further inserting the electronic card 200 downwardly, the lower edge 201 of the electronic card 200 downwardly pushes the lower kicker 33 to make the ejector 3 rotate along an clockwise direction; when the electronic card 200 is completely inserted into the central slot 114, the locking barb 422 rebounds to lock with the lower notch 205 of the right side edge 203 of the electronic card 200, the locking projection 34 locks with the upper notch 204 of the left side edge 202 of the electronic card 200, and the protrusions 31 of the ejector 3 engage with the cutouts 137 to keep the ejector 3 to a locking status.

In a withdrawing process of the electronic card 200, firstly, pressing the upper outer operator 35 to make the ejector 3 rotate along an anticlockwise direction, then the locking projection 34 moves out of the upper notch 204, and the lower kicker 33 pushes one side of the lower edge 201 of the electronic card 200 upwardly to make one side of the lower edge 201 out of the central slot 114; then pulling the electronic card 200 upwardly and sidewardly to make the lower notch 205 of the right side edge 203 disengage with the locking barb 422. Then the electronic card 200 can be dropped out of card edge connector 100.

As fully described above, the retainer 4 in the present invention has the insulator 41 and the locker 42 retained in the insulator 41. The insulator 41 and the retaining portion 421 present as a fastening portion retained in the mounting slot 122. The locking barb 422 flexibly extends to the first cavity 128 and can be deformed in the insertion process of the electronic card 200. Of course, the insulator 41 can be alternatively designed to be unitarily formed with the housing 1, and the housing 1 is formed with a mounting slot recessed from a lower side thereof to retain the locker 42, then the locker 42 can also be hid in the housing 1 and does not expose to outside of the first tower 12, then the retainer 4 can be protected from being collided unexpectedly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for mating with an electronic card, comprising:

an elongated housing having a pair of opposed side walls, a central slot between the side walls for receiving a lower edge of the electronic card and a first tower upwardly extending at one end thereof, the first tower defining a first U-shaped cavity downwardly extending along an insertion direction of the electronic card from a top end thereof and a mounting slot upwardly extending from a lower end thereof and located outside of the first cavity along a length direction of the housing, the first cavity communicating with the central slot along a length direction of the housing to receive a side edge of the electronic card, and the mounting slot communicating with the first cavity along the length direction;

a plurality of contacts retained to the housing; and a retainer having a non-flexible fastening portion retained in the mounting slot and a flexible locking barb obliquely extending into the first cavity from a top end of the fastening portion to lock with the electronic card.

2. The card edge connector as claimed in claim 1, wherein the mounting slot does not upwardly extend through the first tower to make the retainer hidden in the first tower.

3. The card edge connector as claimed in claim 2, wherein the non-flexible fastening portion comprises an insulator and a retaining portion retained in the insulator, and said locking barb unitarily extends from the top end of the retaining portion.

4. The card edge connector as claimed in claim 3, wherein the insulator defines a vertical groove recessed from a front surface thereof along a front to back direction perpendicular to the length direction and the insertion direction, and a lateral groove recessed from an inner surface thereof along the length direction and communicating with a top end of the vertical groove, and the retaining portion has a vertical portion retained in the vertical groove along the front to back direction and a level portion extending from a top end of the vertical portion and retained in the lateral groove.

5. The card edge connector as claimed in claim 4, wherein the locking barb downwardly and obliquely extends from a free end of the level portion, and the locking barb and the level portion defines an obtuse angle therebetween, and the locking barb and the inner surface of the insulator defines an acute angle therebetween to limit a deformation of the locking barb in the insertion process of the electronic card.

6. The card edge connector as claimed in claim 4, wherein the vertical portion has a base and a plurality of carriers forwardly extending from a front side of the base along the front to back direction.

7. The card edge connector as claimed in claim 6, wherein the level portion bends from a top end of the base, and the locking barb, the level portion and the base have same width along the front to back direction.

8. The card edge connector as claimed in claim 4, wherein the first tower has a receiving slot between the first cavity and the mounting slot to receive the locking barb when the locking barb is resisted sidewardly, and a limiting wall between the receiving slot and the mounting slot, and the limiting wall defines a limiting slot recessed from a bottom end thereof to communicate the receiving slot and the mounting slot along the length direction, and the insulator is formed with a raised portion protruding outwardly from an inner surface thereof to engage with the limiting slot for preventing the insulator from moving along the front to back direction.

9. The card edge connector as claimed in claim 8, wherein the lateral groove inwardly extends through the raised portion, and the raised portion is formed with an inclined surface between an intersection position of the raised portion and a lower inner wall of the lateral groove.

10. The card edge connector as claimed in claim 9, wherein the receiving slot sidewardly communicates with the first cavity, and the raised portion has a width same as that of the locking barb along the front to back direction, and the locking barb is located upon the inclined surface and inwardly extends through the limiting slot and the receiving slot into the first cavity.

11. The card edge connector as claimed in claim 3, wherein the first tower defines a pair of openings respectively recessed from two sides thereof, and the insulator has a pair of locking blocks protruding outwardly to engage with the openings for preventing the insulator from moving downwardly.

12. A card edge connector for mating with an electronic card, comprising:

an elongated housing having a pair of opposed side walls, a central slot extending along a length direction between the side walls, a first tower and a second tower upwardly extending from opposite two ends thereof, each first tower and second tower defining a U-shaped cavity downwardly recessed from a top end thereof to receive two side edges of the electronic card and preventing the electronic card from moving along a length direction of the housing;

a plurality of contacts retained to the housing;

a retainer hid in the first tower and not upwardly exposed to an exterior of the housing, the retainer having a non-flexible fastening portion retained in the housing and a flexible locking barb obliquely extending into the first cavity from a top end of the fastening portion to lock with the electronic card; and an ejector retained to the second tower and having a locking projection inwardly extending and located at an upper outer side of the cavity to lock with another side of the electronic card.

13. The card edge connector as claimed in claim 12, wherein the first tower defines a mounting slot upwardly recessed from a lower end thereof to retain the fastening portion, the mounting slot does not extend through the fitting section along an insertion direction of the electronic card and communicate with cavity along the length direction.

14. The card edge connector as claimed in claim 13, wherein the non-flexible fastening portion comprises an insulator and a retaining portion retained in the insulator, and said locking barb unitarily extends from the top end of the retaining portion.

15. The card edge connector as claimed in claim 14, wherein the insulator defines a vertical groove recessed from a front surface thereof along a front to back direction perpendicular to the length direction and the insertion direction, and a lateral groove recessed from an inner surface thereof along the length direction and communicating with a top end of the vertical groove, and the retaining portion has a vertical portion retained in the vertical groove along the front to back direction and a level portion extending from a top end of the vertical portion and retained in the lateral groove.

16. The card edge connector as claimed in claim 15, wherein the locking barb downwardly and obliquely extends from a free end of the level portion, and the locking barb and the level portion defines an obtuse angle therebetween, and the locking barb and the inner surface of the insulator defines an acute angle therebetween to limit a deformation of the locking barb in the insertion process of the electronic card.

17. A card edge connector for retaining a memory module therein, comprising:

an elongated insulative housing defining a center slot extending along a lengthwise direction thereof for receiving the memory module therein;

a plurality of contacts disposed in the housing and located by two sides of the center slot in a lateral direction;

a pair of towers located at two opposite ends of the housing in said lengthwise direction;

an ejector pivotally mounted upon one of said towers and equipped with an upper locker for locking into a notch formed in one side edge of the memory module and a lower kicker for ejecting the memory module out of the center slot; and a retainer located in the other one of said towers and having a resilient locker for locking into another notch of the memory module in another side edge of the memory module; wherein said resilient locker is located between the upper locker and the lower kicker in a vertical direction perpendicular to said lengthwise direction and said lateral direction for easily unloading the memory module from the housing.

18. The card edge connector as claimed in claim 17, wherein said retainer includes an insulator assembled into the tower in said vertical direction, and the resilient locker is assembled into the insulator.

19. The card edge connector as claimed in claim 18, wherein said resilient locker is assembled into the retainer in the lateral direction.

20. The card edge connector as claimed in claim 17, wherein the upper locker is exposed to an exterior in the vertical direction above the corresponding tower while the resilient locker is protectively hidden under the corresponding tower.

* * * * *